US007921819B2

(12) United States Patent
Methley et al.

(10) Patent No.: US 7,921,819 B2
(45) Date of Patent: Apr. 12, 2011

(54) VALVE ACTUATING SYSTEM

(75) Inventors: Ian Methley, Witney (GB); Timothy Mark Lancefield, Shipston on Stour (GB)

(73) Assignee: Mechadyne PLC, Kirtlington (GB)

( * ) Notice: Subject to any disclaimer, the term of this patent is extended or adjusted under 35 U.S.C. 154(b) by 340 days.

(21) Appl. No.: 12/109,471

(22) Filed: Apr. 25, 2008

(65) Prior Publication Data

US 2009/0266320 A1 Oct. 29, 2009

(51) Int. Cl.
*F01L 1/34* (2006.01)

(52) U.S. Cl. ..... 123/90.16; 123/90.52; 123/90.39

(58) Field of Classification Search ..... 123/90.16, 123/90.52, 90.55, 90.39
See application file for complete search history.

(56) References Cited

U.S. PATENT DOCUMENTS

| | | | | |
|---|---|---|---|---|
| 7,134,411 | B2 | 11/2006 | Lancefield et al. | |
| 2004/0244751 | A1 * | 12/2004 | Falkowski et al. | 123/90.55 |
| 2006/0112914 | A1 * | 6/2006 | Lancefield et al. | 123/90.4 |

FOREIGN PATENT DOCUMENTS

| | | |
|---|---|---|
| EP | 1148213 | 10/2001 |
| GB | 2421765 | 5/2006 |

* cited by examiner

*Primary Examiner* — Zelalem Eshete
(74) *Attorney, Agent, or Firm* — Chernoff, Vilhauer, McClung & Stenzel

(57) ABSTRACT

An actuating system for a gas exchange valve of an internal combustion engine is described which comprises two cams (12,14) associated with the valve (10), a summation linkage (22,24,30,32) for lifting the valve in dependence upon the sum of the instantaneous lifts of the two cams (12,14). A de-activating mechanism 34 is provided for selectively decoupling the summation linkage from one (12) of the two cams.

7 Claims, 2 Drawing Sheets

VALVE ACTUATING SYSTEM

FIELD OF THE INVENTION

The present invention relates to a variable valve actuating system for a gas exchange valve of an internal combustion engine and seeks to provide a system in which a valve may be operated with a main event and a selectable auxiliary event.

BACKGROUND OF THE INVENTION

There are different occasions in which it is desirable to operate an engine gas exchange valve in one of two modes, the valve, in one mode, having a single main event and, in the other mode, having both a main and an auxiliary event.

For example, an exhaust valve is conventionally opened during the exhaust stroke and closed near top centre at which time the intake valve is opened. Overlap between the opening events of the two valves results in internal exhaust gas recirculation which improves engine performance under some engine operating conditions but not others. To optimise the degree of internal EGR under different operating conditions, it is desirable to have an auxiliary opening of the exhaust valve during the intake that may be selectively enabled and disabled. A similar effect can be achieved by providing an intake valve with a selectable event during the exhaust stroke.

As a further example, opening an exhaust valve near top dead centre on the firing stroke acts as a compression brake which is desirable under some conditions but not others. A system that allows an auxiliary event to be selectively enabled and disabled allows an engine compression brake to be activated as required.

SUMMARY OF THE INVENTION

According to the present invention, there is provided an actuating system for a gas exchange valve of an internal combustion engine, comprising two cams associated with the valve, a summation linkage for lifting the valve in dependence upon the sum of the instantaneous lifts of the two cams, and means for selectively decoupling the summation linkage from one of the two cams, wherein the summation linkage comprises a first rocker driven by the first cam through a first cam follower and acting directly on the valve, and a second rocker driven by the second cam through a second cam followed and acting to displace the pivot of the first rocker, and wherein the means for selectively decoupling the summation from one of the two cams is operative to isolate the second rocker from the second cam while inhibiting movement of the pivot of the first rocker in a direction to reduce valve lift.

Valve actuating mechanisms that sum the lift from two cams using a summation linkage are known. In particular, U.S. Pat. No. 6,854,434, EP 1426569 and GB 0519876.7 describe such a system which is commonly referred to as a VLD (variable lift and duration) system. However, unlike the present invention, where the two cam profiles need not overlap, the cam profiles conventionally used in a VLD mechanism have a large overlap and achieve variable duration and lift by changing the relative phase between the two cams.

Valve trains that include a deactivating mechanism are also known. These usually comprise of a hydraulically actuated switching mechanism and a lost motion spring assembly. US 2005/0045132 gives an example of such a mechanism that is applicable to a cam-in-block pushrod engine.

The present invention combines the summation mechanism as used in a VLD system with a deactivating mechanism acting on one of two cams associated with a single valve to provide a simple and compact package that can achieve a selectable auxiliary valve event for exhaust braking or for generating internal EGR.

Conveniently, the second rocker may rotate an eccentric shaft serving as the pivot of the first rocker and, if desired, the second rocker may be formed integrally with the eccentric shaft.

A return spring can be advantageously provided to bias the second rocker or the eccentric shaft to control the motion of the eccentric shaft when the second rocker is isolated from the second cam.

While the two cams can be fixedly mounted on a common camshaft, it is alternatively possible for the two cams to be adjustable in phase relative to one another and for them to form part of an assembled SCP (single cam phaser) camshaft.

BRIEF DESCRIPTION OF THE DRAWINGS

The invention will now be described further, by way of example, with reference to the accompanying drawings, in which.

BRIEF DESCRIPTION OF THE PREFERRED EMBODIMENT(S)

Figure 1:
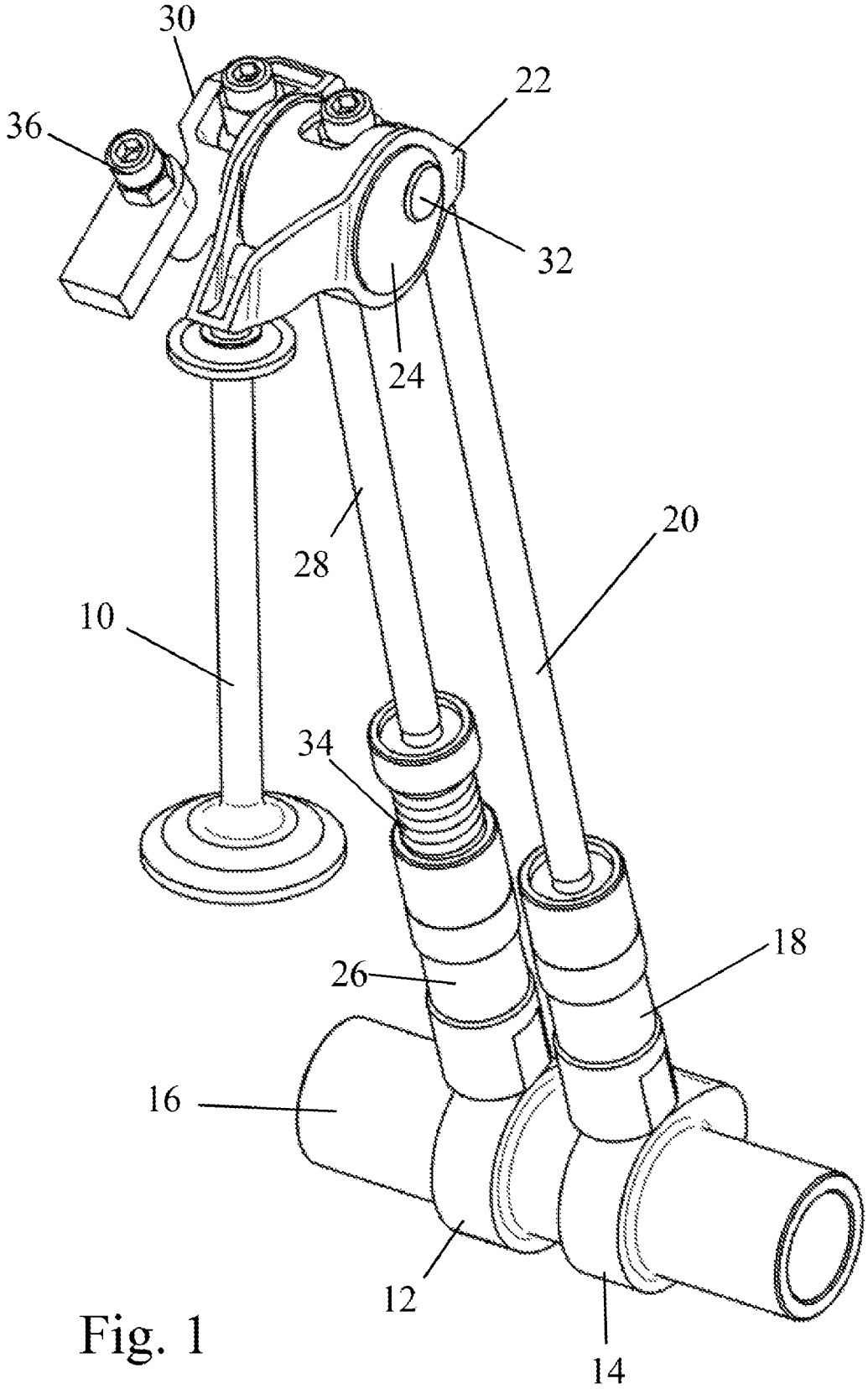
FIG. 1 is a perspective view of a valve actuating system in accordance with the present invention.
Figure 2:
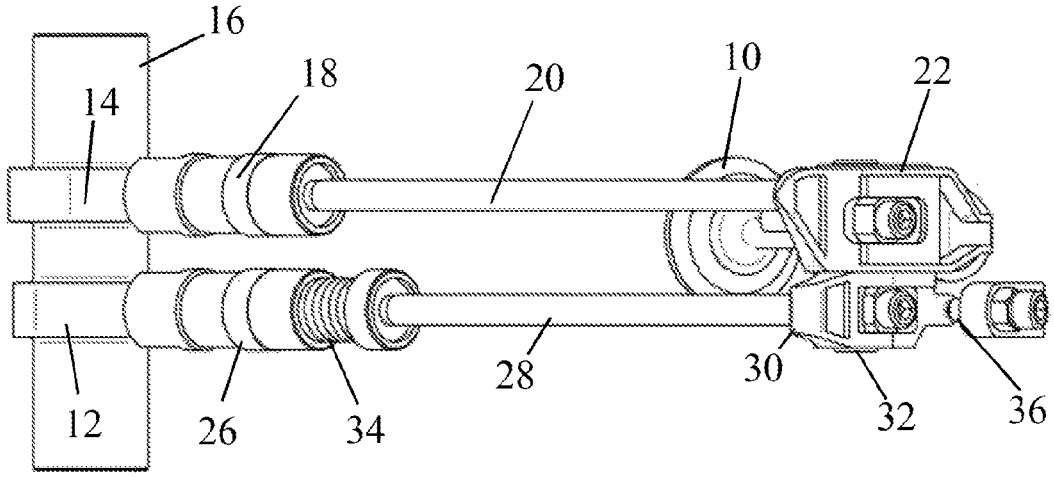
FIG. 2 is a plan view of the valve actuating system in FIG. 1.
Figure 3:
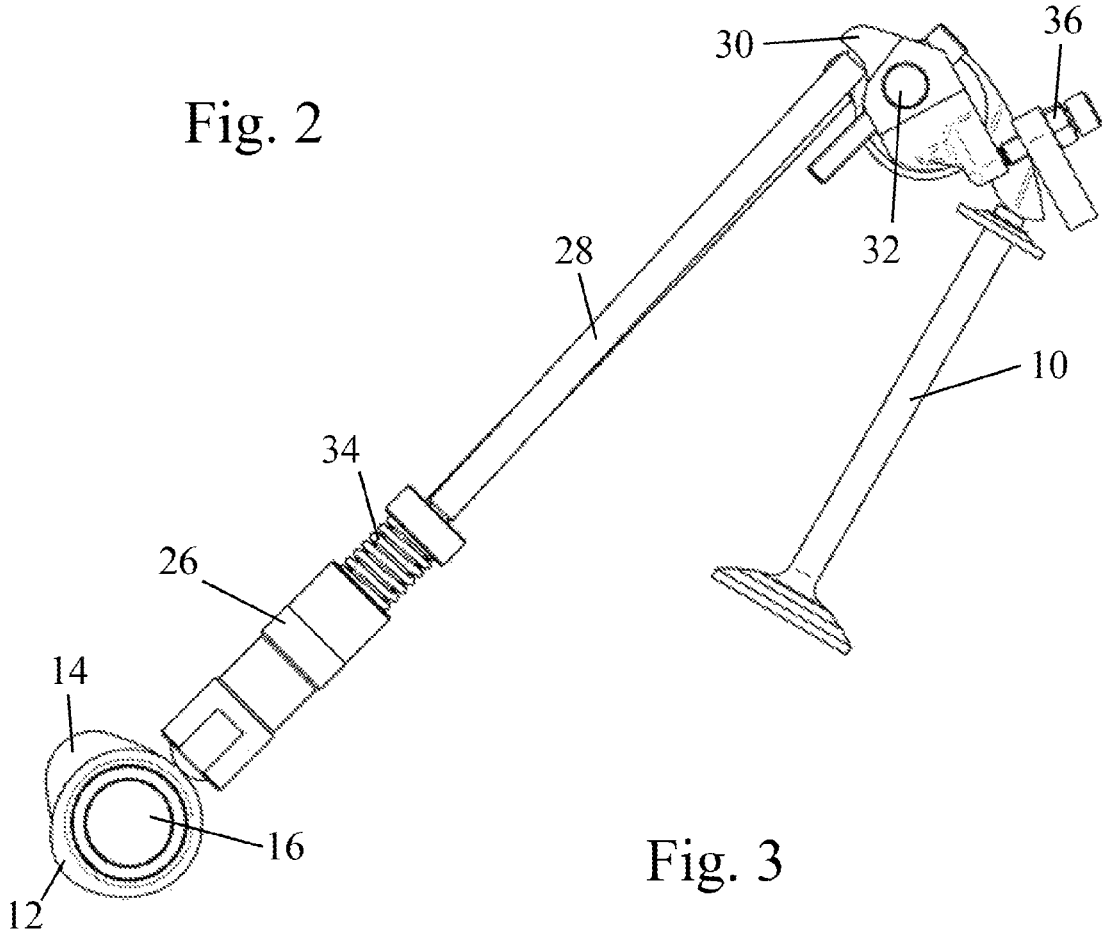
FIG. 3 is a side view of the valve actuating system of FIGS. 1 and 2, as seen from the left in FIG. 1.

The drawings show an embodiment of the invention applied to an engine with an overhead gas exchange valve 10 operated by two cams 12 and 14 forming part of a one-piece camshaft 16 mounted in the engine block. In the interest of clarity, only the engine valve operated by the valve actuating system of the present invention is shown.

The main event of the valve 10, which occurs in all operating modes is determined by the cam 14 which acts on the valve 10 by way of a cam follower 18, a push rod 20 and a first rocker 22 that is pivotable about an eccentric 24. The valve 10 is opened during the selectable auxiliary event by the cam 12 which acts by way of a cam follower 26 and push rod 28 on a second rocker 30. The second rocker 30 is integrally formed with, or is fast in rotation with eccentric 24. 24 pivot about shaft 32.

The cam follower 26 associated with the second cam 12 incorporates a de-activating mechanism 34 which is a spring biased lost motion coupling that is latchable in its extended position. When unlatched, the cam follower 26 can continue to follow the cam 12 while the push rod 28 remains stationary, and during this time the movement of the follower is taken up by the lost motion coupling 34. The spring ensures that the push rod 28 remains in contact with the second rocker 30. When the de-activating mechanism 34 is latched, on the other hand, then movement of the cam follower 26 is transmitted through the push rod 28 to the second rocker 30 in the same way as movement of the cam 14 is transmitted to the first rocker 22.

A fixed stop 36, which may itself be constructed as a hydraulic lash adjuster, is provided to limit the rotation of the second rocker 30 in one direction while allowing it to rotate freely in the other.

The operation of the valve actuating system will now be described and ease of understanding reference will be made to directions such as "upward" and "clockwise" and these all refer to the orientation shown in FIG. 1.

The two rockers 22 and 30, the pivot shaft 32 and the eccentric 24 together form a summation linkage that lifts the valve 10 by an amount determined by the sum of the movements of the two push rods 20 and 28.

In all operating modes, upward movement of the push rod 20 causes the rocker 22 to pivot counter-clockwise about the eccentric 24 and to act directly on the valve 10 in a direction to open the valve 10.

When the de-activating mechanism 34 is latched in its extended position, upward movement of the push rod 28 causes the rocker 30 to pivot counter-clockwise. This in turn rotates the eccentric 24 counter-clockwise to lower the pivot axis of the first rocker 22, which results indirectly in the opening of the valve 10. When the de-activating mechanism 34 is unlatched, movement of the cam only results in extension and contraction of the lost motion coupling and no movement is transmitted to the push rod, nor to the second rocker 30.

Consequently, with the de-activating mechanism 34 latched, the valve 10 is opened during each cycle of rotation of the camshaft 16 by both the cams 12 and 14 whereas when it is unlatched only the cam 14 opens the valve 10 and the rotation of the cam 12 has no effect upon the valve 10.

As the push rod 20 moves upwards to open the valve 10, there is a force on the eccentric 24 tending to rotate it in a clockwise direction. Unless this is prevented, instead of the rocker 22 pivoting about the eccentric 24 and opening the valve 10, it would pivot about the tip of the valve 10 and rotate the eccentric 24 clockwise about shaft 32 as the pivot axis of the rocker 22 is raised.

As such motion of the eccentric 24 would prevent the valve 10 from being opened by the cam 14, the stop 36 is provided to prevent the end of the second rocker 30 from rising about a fixed point. As the rocker 30 is fast in rotation with the eccentric 24, this prevents clockwise rotation of the eccentric about shaft 32 and consequent upward movement of the pivot axis of the rocker 22. The illustrated embodiment shows the stop 36 as being an adjustable screw but it may alternatively be designed as a hydraulic lash adjuster.

The invention has been described with reference to an embodiment in which the two cams are fixed in phase relative to one another. This is desirable from a cost saving viewpoint and reflects the aim of the invention which is to achieve a selectable second valve event using an compact and uncomplicated valve actuation system. It will nevertheless be appreciated that the invention may be used with cams that can be changed in phase relative to one another, such as the cams of an assembled SCP camshaft.

It will further be appreciated that various other modifications may be made to the described embodiment of the invention without departing from the scope of the invention as set out in the appended claims. For example, it is not essential for the engine to have a cam-in-block design and the invention would be equally applicable to engines with overhead camshafts. Furthermore, the summation linkage need not necessarily rely on a rocker mounted on a eccentric, but use may be made of alternative summation linkages, of which examples will be found in the prior art.

The invention claimed is:

1. An actuating system for a gas exchange valve of an internal combustion engine, comprising:

first and second cams associated with the valve, a summation linkage for lifting the valve in dependence upon the sum of the instantaneous lifts of the first and second cams, the summation linkage comprising a first rocker driven by the first cam through a first cam follower and acting directly on the valve, and a second rocker driven by the second cam through a second cam follower and acting to displace the pivot of the first rocker, a decoupler for selectively isolating the second rocker from the second cam, and a stop for restricting rotation of the second rocker in one direction, so as to enable the valve to be lifted by the action of the first cam while the second rocker is isolated from the second cam.

2. A valve actuating system as claimed in claim 1, wherein the second rocker acts to rotate an eccentric shaft serving as the pivot of the first rocker.

3. A valve actuating system as claimed in claim 2, wherein a return spring is provided to bias the second rocker or the eccentric shaft to control the motion of the eccentric shaft when the second rocker is isolated from the second cam.

4. A valve actuating system as claimed in claim 1, wherein the second rocker is formed integrally with the eccentric shaft.

5. A valve actuating system as claimed in claim 1, wherein the decoupler comprises a spring biased lost motion mechanism in the force transmission path from the second cam to the second rocker and a de-activating mechanism for latching the lost motion mechanism in an extended position.

6. A valve actuating mechanism as claimed in claim 1, wherein movement of the pivot of the first rocker in a direction to reduce valve lift is inhibited by means of a hydraulic lash adjuster acting on the second rocker.

7. A valve actuating system as claimed in claim 1, wherein the two cams are adjustable in phase relative to one another and form part of an assembled camshaft.

* * * * *